United States Patent [19]

Perez

[11] 4,052,816

[45] Oct. 11, 1977

[54] WINDOW STAND FOR PLANTS

[76] Inventor: Frank Perez, 661 2nd Place, Garden City South, N.Y. 11530

[21] Appl. No.: 673,213

[22] Filed: Apr. 2, 1976

[51] Int. Cl.[2] ..... A47G 7/00; A01G 9/02

[52] U.S. Cl. ..... 47/40; 47/68; 108/46; 211/88; 248/208

[58] Field of Search ..... 47/18, 39, 40, 36, 34.11, 47/68; 108/46, 25; 211/87, 88, 90; 248/208

[56] References Cited

U.S. PATENT DOCUMENTS

| | | | |
|---|---|---|---|
| 876,235 | 1/1908 | Quackenboss | 47/36 X |
| 2,019,249 | 10/1935 | Bradley | 47/36 |
| 2,491,271 | 12/1949 | King | 47/18 |
| 2,590,793 | 3/1952 | Rigstad | 211/88 |
| 2,966,272 | 12/1960 | Mackenzie | 248/208 X |
| 3,852,912 | 12/1974 | Diller | 47/34.11 |
| 3,946,522 | 3/1976 | Schifman | 47/36 |

*Primary Examiner*—Edward M. Coven
*Assistant Examiner*—James R. Feyrer
*Attorney, Agent, or Firm*—Kenyon & Kenyon, Reilly, Carr & Chapin

[57] ABSTRACT

A window stand for plants that is especially suited for mounting on an inner the window sill and provides for drainage of water, to the outdoors. The stand is in the form of an elongated shelf member having a corrugated bottom of alternating transverse ridges and valleys. The ridges are coplanar and level when the shelf is installed on a window sill, to hold flower pots upright without tilting. The valleys slope downward toward the outside edge of the inner sill, to allow any excess water to drain outward under the sash.

6 Claims, 3 Drawing Figures

WINDOW STAND FOR PLANTS

BACKGROUND OF THE INVENTION

This invention relates to an interior window stand for flower pots and the like. More particularly, the invention relates to a stand that is adapted to provide for water drainage from the flower pots to run outward towards the window sash receiving channel and out of the room rather than permitting the same to collect on the stand.

The prior art teaches a variety of plant stands and the like, for example, as disclosed in U.S. Pat. Nos. 1,084,414; 1,293,785; 2,019,249; 2,063,289; 2,085,290; 3,269,551; 3,319,378; 3,879,891; and others.

SUMMARY OF THE INVENTION

It is accordingly an object of the invention to provide for an improved window stand for plants.

It is another object to provide for a stand having the aforementioned qualities.

It is a further object for the same at relatively little cost thereby making it generally available.

These and other objects and advantages of the invention will become more apparent from the following detailed disclosure and claims and by reference to the accompanying drawings, in which:

Broadly speaking, the instant invention provides a flower pot stand adapted to be attached on a window sill and extend inwards towards the interior of a room. The stand comprises an elongated shelf member bounded by outside edge, an inside edge, and two ends. The shelf member is formed with a plurality of alternating transverse ridges and valleys, each of said ridges having a substantialy flat upper surface for receiving a flower pot thereon, each of the surfaces being in planar alignment, and the valleys interposed between the alternating ridges being inclined downward with respect to the plane of the ridges from the inside edge to the outside edge so that, when the shelf member is mounted on the window sill, water drainage is carried away from the room towards the window.

DETAILED DISCLOSURE

Figure 1:
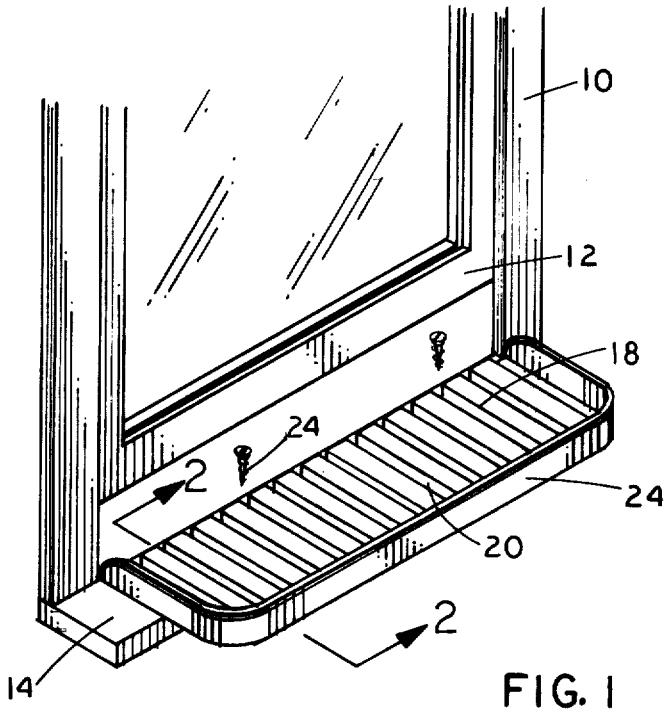
FIG. 1 is a perspective view.
Figure 2:
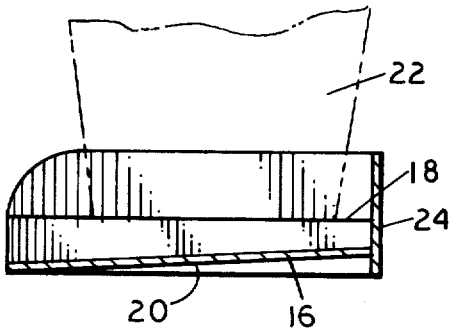
FIG. 2 is a side sectional elevational view taken along line 2—2 of FIG. 1.

Referring to the FIG. 1, there is shown a conventional window having a frame 10 with a double hung sash 12 therein slidably mounted, though the invention is not limited to any particular type of window. The bottom of window frame 10 has a substantially horizontally disposed window sill 14 attached thereto and extending into the room perpendicular to the window sash 12. The outer edge of the sill 14 abuts the inner face of the bottom of the window sash 12 when the same is in the closed position against the base of the window track.

The present invention is a substantially rectangular shelf member 16 that is adapted to be attached to the sill 14 with the outside edge of the shelf member aligned with the outer edge of the sill, the shelf member extending therefrom towards the interior of the room. The member 16 has disposed along one surface thereof, i.e., the top surface, a plurality of alternating ridges 18, and valleys 20. The ridges are in planar alignment relative to each other and are parallel to sill 14. Each of the valleys 20 provides a drainage surface that is pitched or slanted downward away from the plane of the ridges 18 towards the outer edge of sill 14. The plurality of drainage surfaces are adapted to carry excess water away from the room towards the exterior via the window channel. The ridges 18 are, level and thus support a flower pot 22 or the like. Water drainage therefrom does not sit on the ridges 18 but rather drips downward into the recesses therebetween and thus onto the slanted surfaces 20 and hence away from the room.

Figure 3:
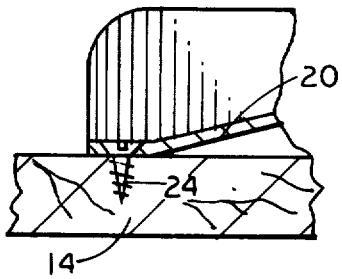
FIG. 3 is an enlarged view of the outer edge portion of the stand.

As shown in FIG. 3, the entire unit may be affixed to the window sill 14 or the channel by any suitable means, such as screws 24 or the like. The unit that forms the alternating ridges and recesses or a convoluted or sinuous shaped member may have unitary construction and be removably inserted onto the member 16 or be integral or unitary therewith.

In the preferred emodiment, the outside edge and both ends of the member 16 are bounded by an upright flange 26 that functions as a rim or border around the shelf to reduce the opportunity for the pots 22 to fall therefrom and to support the shelf member so that the plane of the ridges is parallel to the sill. The entire unit may be constructed of any suitable rigid material such as plastic, wood, metal, etc. The upper surfaces of the ridges 18 will be flat, the surfaces 20 need not be, as long as the same are inclined downward away from the longitudinal flange 24.

Since changes and modifications can be made in the above-described details without departing from the spirit and nature of the invention, it is to understood that equivalents of such details are included within the scope of the invention.

I claim:

1. A window stand for potted plants comprising an elongated shelf member bounded by an outside longitudinal edge, an inside longitudinal edge, and two ends, the shelf member being formed into alternating ridges and valleys extending transversely between said inside and outside longitudinal edges, the tops of the ridges lying in a common plane, and the bottoms of the valleys being inclined with respect to said plane downward from the inside edge to the outside edge of the shelf member; and a continuous upright flange formed integrally with the shelf member, the flange enclosing the inside edge and the two ends of the shelf member and extending above the plane of the ridge tops, and the flange having a lower edge at each of said ends adapted to support the shelf member on an inside horizontal sill of a window with the plane of said ridge tops parallel to and spaced above the plane of the sill and with the outside edge of the shelf aligned with the outside edge of the sill adjacent to the inner face of a window sash, whereby potted plants placed on the shelf will stand upright on the ridge tops without tilting and will be protected by the flange from falling off the shelf, and the valleys will provide parallel drainage paths for excess water from such pots to the outdoors over the edge of the sill.

2. A stand according to claim 1 wherein the shelf member is substantially rectangular.

3. A stand according to claim 1 wherein the continuous upright flange has a constant height thereby providing stiffness to the shelf member in addition to support at the ends thereof.

4. A stand according to claim 1 wherein the tops of the ridges are substantially flat to provide stable support for potted plants.

5. A stand according to claim 4 wherein the bottoms of the valleys are flat and coplanar.

6. A stand according to claim 5 wherein the shelf member is a unitary structure of plastic material.

* * * * *